US006138431A

United States Patent [19]

da Encarnação

[11] Patent Number: 6,138,431

[45] Date of Patent: Oct. 31, 2000

[54] VIRTUAL BLOCK FOR ATTACHMENT TO A PREFABRICATED CEILING SLAB

[76] Inventor: Fernando Antonio Franco da Encarnação, Rua Leobina Pereira, 38, Jardin São Paulo, Recife-PE, Brazil

[21] Appl. No.: 09/170,738

[22] Filed: Oct. 13, 1998

[51] Int. Cl.[7] ..... E04B 1/38

[52] U.S. Cl. ..... 52/763; 52/506.08; 52/762

[58] Field of Search ..... 52/319, 320, 325, 52/335, 336, 470, 471, 472, 483.1, 489.1, 763, 962, 506.01, 506.06, 506.07, 506.08, 506.09, 578, 582.1, 589.1, 590.1, 590.2, 590.3, 508

[56] References Cited

U.S. PATENT DOCUMENTS

| | | | |
|---|---|---|---|
| 1,854,438 | 4/1932 | Wray | 52/762 X |
| 3,242,626 | 3/1966 | Blok | 52/762 X |
| 3,303,622 | 2/1967 | Minds, Jr. | 52/762 X |
| 4,184,303 | 1/1980 | Hassman | 52/762 X |
| 4,270,327 | 6/1981 | Van Leeuwen | 52/762 X |
| 4,510,727 | 4/1985 | Jury | 52/508 |
| 4,909,013 | 3/1990 | Daw et al. | 52/762 |
| 5,115,611 | 5/1992 | Lim et al. | 52/763 |
| 5,475,962 | 12/1995 | Horsten et al. | 52/506.08 |

*Primary Examiner*—Richard Chilcot
*Attorney, Agent, or Firm*—Harrison & Egbert

[57] ABSTRACT

A virtual block for attachment to a prefabricated ceiling slab including a body with a first stirrup at one end and a second stirrup at an opposite end, a first channel formed on one side of the body and extending lengthwise thereacross, a second channel formed on an opposite side of the body and extending lengthwise thereacross, and a plurality of teeth formed along a bottom edge of the body. Each of the first and second stirrups has a flat bottom surface suitable for resting on a surface of the ceiling slab. The first and second channels are located below this flat bottom surface of the stirrups. The plurality of teeth define a receptacle area between adjacent pairs of the teeth. The receptacle area is suitable for the receipt of connecting portions of a ceiling panel for a profile member.

20 Claims, 2 Drawing Sheets

FIG. 1
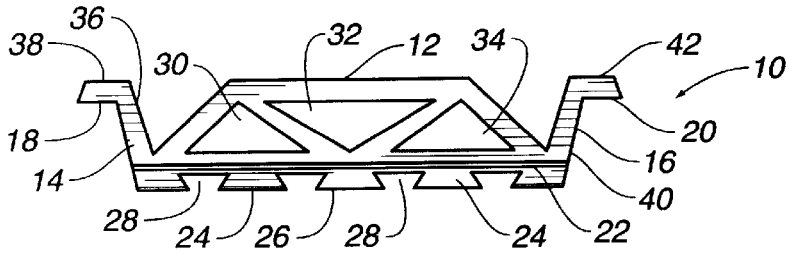
FIG. 2
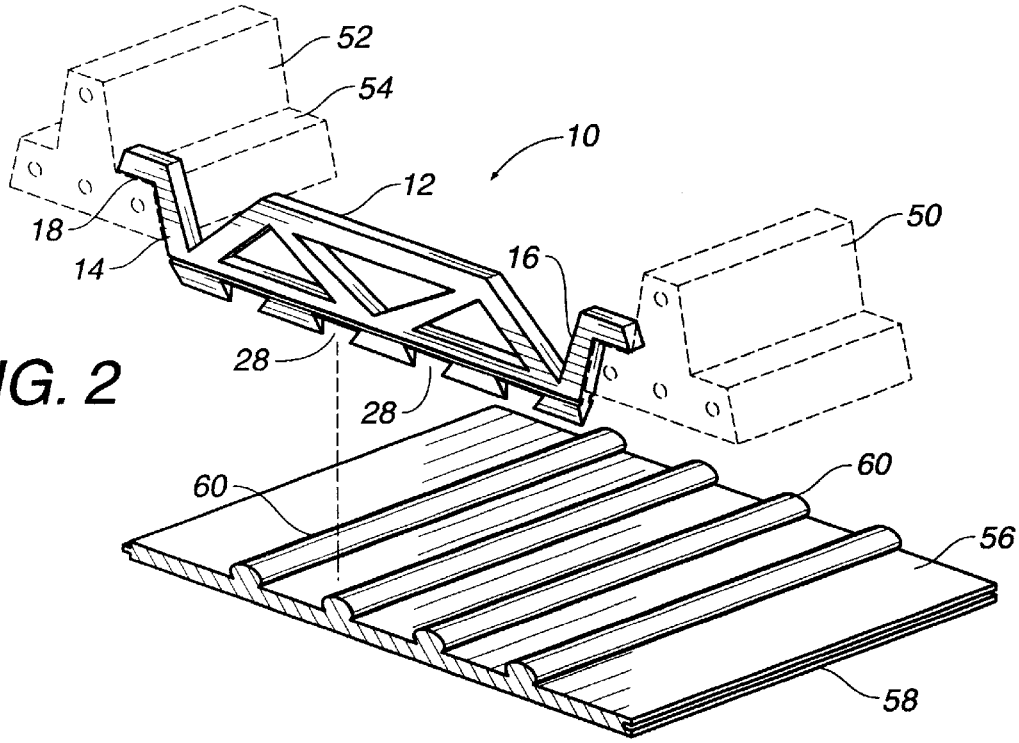
FIG. 3
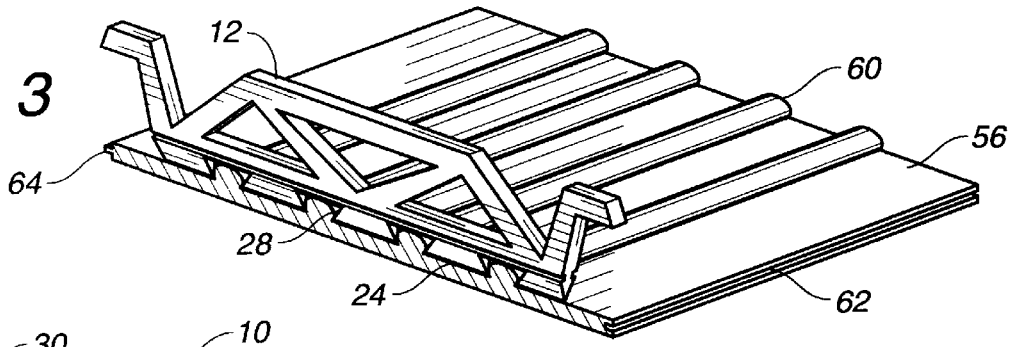
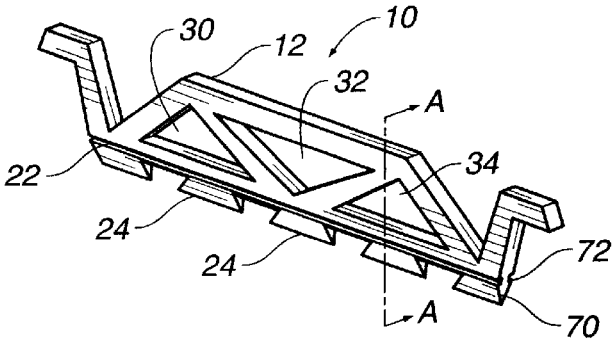
FIG. 4

VIRTUAL BLOCK FOR ATTACHMENT TO A PREFABRICATED CEILING SLAB

TECHNICAL FIELD

The present invention relates to the constructions of buildings. More particularly, the present invention relates to the installation of ceilings on prefabricated slabs. Furthermore, the present invention relates to various means for attachment of ceilings panels to the ceiling slabs.

BACKGROUND ART

The conventional techniques adopted by civil construction work for fabrication of pre-molded slabs have been introducing important changes of materials and technology. Among them, the introduction of foam blocks and virtual blocks can be considered as an outstanding improvement in the range of engineering needs. The virtual blocks can help to reduce the cost of construction and the time required for finishing the construction works.

The finishing work for ceilings constructed with conventional pre-fabricated slabs demands a multi-stage approach. Initially, cement is hand trowelled. Next, the plastering operation occurs. Finally, the process is completed with finishing putty and painting. Under normal conditions, to carry out such work, three days are required for the cement curing, another eight days for the plastering, two days for the putty layering, and at least three days for the drying of the paint. This requires sixteen days for the finishing work. Invariably, this type of finishing will result in cracks and overloads of the structural frame. All of these stages demand a human effort and proper working conditions. Furthermore, the weight of the structure increases and costs increase.

It is an object of the present invention to provide a virtual block which allows for the construction of ceilings in a very short time and at a very low cost.

It is another object of the present invention to provide a virtual block which is light, easy to assemble, and able to withstand changes and remodeling, if required.

It is a further object of the present invention to provide a virtual block which can be fabricated from fire-retardant materials.

These and other objects and advantages of the present invention will become apparent from a reading of the attached specification and appended claims.

SUMMARY OF THE INVENTION

The present invention is a virtual block for attachment to a prefabricated ceiling slab comprising a body having a first stirrup at one end and a second stirrup at an opposite end, a first channel formed on one side of the body and extending lengthwise thereacross, a second channel formed on the opposite side of the body and extending lengthwise thereacross, and a plurality of teeth formed along a bottom edge of the body. Each of the first and second stirrups has a flat bottom surface suitable for resting on a surface of the ceiling slab. The first and second channels extend across the body below the flat bottom surface of the stirrups. The plurality of teeth define a receptacle area between adjacent pairs of the plurality of teeth.

In the preferred embodiment of the present invention, the body has a generally trapezoidal shape. The first and second stirrups extend outwardly of this trapezoidal shape. The first and second stirrups include an arm which extends upwardly and outwardly from a side of the body and a support portion which extends horizontally outwardly of an end of the arm opposite the body. The first and second channels are aligned with each other and are positioned in coplanar relationship on opposite sides of the body.

The receptacle area is suitable for receiving a ceiling panel therein. The ceiling panel can include a plurality of ribs extending thereacross. The plurality of ribs are received by the receptacle areas so as to support the ceiling in a horizontal position below the virtual block. The ceiling panel can be connected to an adjacent ceiling panel through the use of tongue-in-groove techniques. Suitable profile members can be received within the channel and/or within the receptacle areas of the body.

BRIEF DESCRIPTION OF THE DRAWINGS

FIG. 1 is a frontal view of the virtual block in accordance with the teachings of the present invention.

FIG. 2 is an exploded view showing the assembly of the virtual block on the ceiling slab and the receipt of a ceiling panel within the receptacle areas.

FIG. 3 is a perspective view showing the attachment of the ceiling panel to the virtual block.

FIG. 4 is a perspective view of the virtual block in accordance with the present invention.

DETAILED DESCRIPTION OF THE INVENTION

Figure 5:
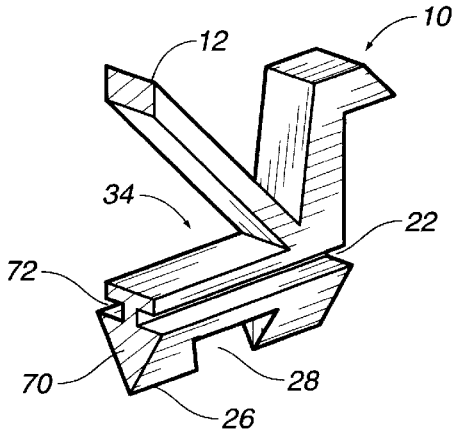
FIG. 5 is a cross-sectional view taken across lines A—A of FIG. 4.

Referring to FIG. 1, there is shown at 10 the virtual block for attachment to a prefabricated ceiling slab in accordance with the preferred embodiment of the present invention. The virtual block 10 includes a body 12 having a length dimension extending thereacross. The body 12 has a first stirrup 14 at one end and a second stirrup 16 at an opposite end. The first stirrup 14 has a flat bottom surface 18 suitable for resting on a surface of the ceiling slab. The second stirrup 16 has a flat bottom surface 20 suitable for resting on the surface of another ceiling slab. A first channel 22 is formed on one side of the body 12 and extends lengthwise thereacross below the flat bottom surfaces 18 and 20 of the stirrups 14 and 16, respectively. A second channel (not shown) is formed on the opposite side of the body and extends lengthwise thereacross. A plurality of teeth 24 are formed along a bottom edge 26 of the body 12. The plurality of teeth define receptacle areas 28 between adjacent pairs of the plurality of teeth 24.

As can be seen in FIG. 1, the body 12 has a generally trapezoidal shape. The first stirrup 14 and the second stirrup 16 extend outwardly of this trapezoidal shape. The trapezoidal shape of the body 12 includes a plurality of triangular cut-outs 30, 32 and 34 formed in the body 12. The triangular cut-outs 30, 32 and 34 serve to reduce the weight of the virtual block 10.

As can be seen in FIG. 1, the first stirrup 14 has an arm 36 extending upwardly and outwardly from one end of the body 12. A support portion 38 extends horizontally outwardly of an end of the arm 36 opposite the body 12. The flat bottom surface 18 is formed on the support portion 38.

The second stirrup 16 includes an arm 40 which extends upwardly and outwardly from an opposite end of the body 12. A support portion 42 extends horizontally outwardly of an end of the arm 40 opposite the body 12. The flat bottom 20 is formed on the support portion 42.

It can be seen in FIG. 1 that each of the plurality of teeth 24 has a generally trapezoidal shape. Similarly, the receptacle areas 28 have openings which lead to a generally trapezoidal-shaped interior. The receptacle areas 28 open along the bottom edge 26 of the body 12.

In FIG. 2, it can be seen that the body 12 is supported between a first ceiling slab 50 and a second ceiling slab 52. As can be seen, the flat bottom surface 18 of the first stirrup 14 rests upon a rib 54 on ceiling slab 52. Similarly, the flat bottom surface 20 of the second stirrup 16 rests upon a rib formed on the second ceiling slab 50. In this manner, the virtual block 10 is properly positioned between the ceiling slabs 50 and 52.

In FIG. 2, a ceiling panel 56 is shown in position for connection within the receptacle areas 28 of the body 12. The ceiling panel 56 has a flat bottom surface 58. A plurality of ribs 60 extend across the ceiling panel 56. The ribs 60 are suitable for receipt within the receptacle areas 28 formed on the bottom of body 12.

FIG. 3 shows the manner in which the ceiling panel 56 is connected to the body 12. As can be seen, the ribs 60 are affixed within the receptacle areas 28 formed on the bottom of body 12. The teeth 24 will reside in flat surface-to-surface contact with the areas between the ribs 60 on the top surface of ceiling panel 56. The ceiling panel 56 is illustrated as having a groove 62 extending across an edge of the ceiling panel 56 in a direction transverse to the length dimension of the body 12. A tongue 64 is formed on the opposite side of the ceiling panel 56 and, similarly, extends transverse to the length dimension of the body 12. This tongue-in-groove arrangement allows the ceiling panel 56 to be connected to an adjacent ceiling panel so as to form a finished ceiling.

FIG. 4 shows a perspective view of the virtual block 10. In FIG. 4, it can be seen how the triangular cut-outs 30,32 and 34 are formed in the trapezoidal-shaped body 12. The channel 22 extends across the length dimension of the body 12 above the location of the teeth 24. The teeth 24 form a triangular cross-sectional area 70 below the channel 22. It can be further seen that the second channel 72 is formed on the opposite side of body 12.

FIG. 5 is a cross-sectional view of the virtual block 10. It can be seen that the body 12 has triangular cut-out area 34 formed therethrough. A first channel 22 extends lengthwise along the body 12. The second channel 72 extends in co-planar relationship on the opposite side of the body 12 from the first channel 22. A triangular cross-section 70 is formed in the area below the channels 22 and 72. The narrow end of the triangular cross-section 70 is located at the bottom edge 26 of body 12.

Figure 6:
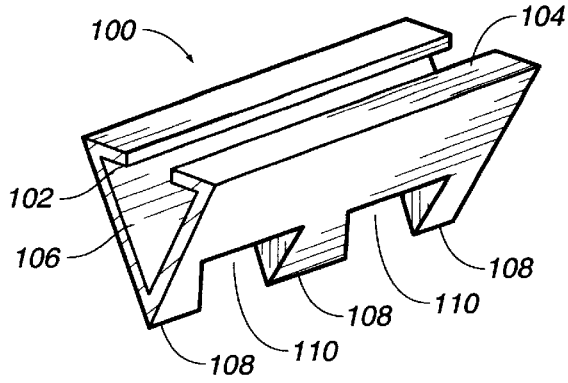
FIG. 6 is a perspective end view showing one type of profile member that can be received on the virtual block of the present invention.

For the installation of a ceiling panel, the present invention allows for the use of profile members. FIG. 6 shows one type of profile member 100. Profile member 100 has tongues 102 and 104 extending inwardly from a triangular opening 106. Tongues 102 and 104 engage the grooves 22 and 72, respectively, in the body 12. The triangular cross-section area 70 will reside in the triangular open area of the profile member 100. The profile member 100 has trapezoidal-shaped teeth 108 along a bottom edge. These teeth 108 define receptacle areas 110 therebetween. As such, the profile member 100 can be affixed over the teeth 26 of the body 12 such that the receptacle areas 110 can receive a different configuration of ceiling panel.

Figure 7:
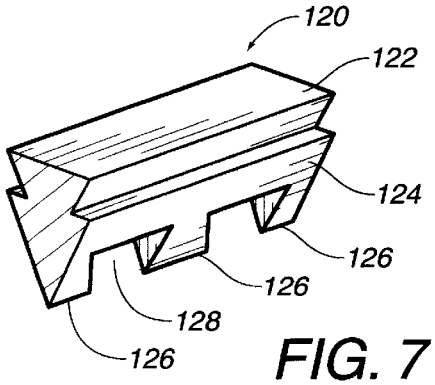
FIG. 7 is a perspective view of a second type of profile member that can be received within the virtual block of the present invention.

Another type of ceiling panel 120 is illustrated in FIG. 7. The profile member 120 has a section 122 which can be slidably received within the receptacle area 28 of the body 12. The walls of section 122 will conform with the shape of the walls of the receptacle area 28, as formed by the teeth 26. Member 124 extends downwardly from section 122 and includes teeth 126 which define receptacle areas 128 therebetween. The receptacle areas 128 are suitable for the receipt of a ceiling panel or other item. The arrangement of the receptacle areas 128 on the profile member 120 allows the connectors with the ceiling panels to extend in a different direction or orientation than that shown in FIG. 2.

Figure 8:
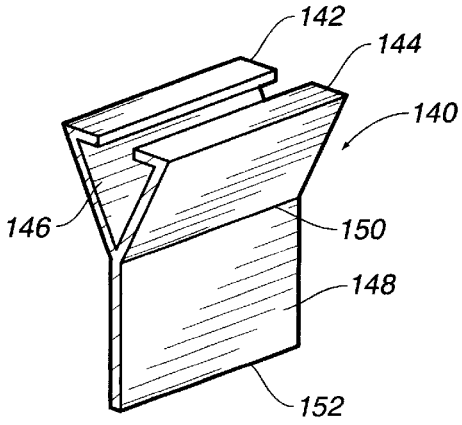
FIG. 8 is a perspective end view of a third type of profile member that can be received within the virtual block of the present invention.

FIG. 8 shows another type of profile member 140. Profile member 140 has tongues 142 and 144 which extend inwardly so as to engage the channels 22 and 72 on the body 12. A triangular-shaped open area 146 is formed in the profile member 140. As such, the triangular-shaped cross-sectional area 70 of the body 12 will be received in this triangular-shaped area 146. A panel 148 will extend downwardly from the bottom edge 150 of the profile member 140. Panel 148 has a flat and straight bottom edge 152.

Figure 9:
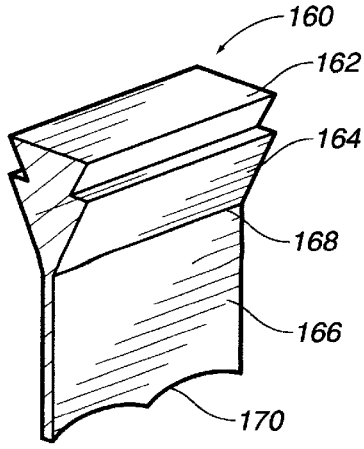
FIG. 9 is a perspective view of a fourth type of profile member that can be received within the virtual block of the present invention.

FIG. 9 shows another profile member 160 suitable for receipt within the receptacle area 28 of body 12. The profile member 160 has a section 162 which is configured for receipt within the receptacle area 28. Another section 164 extends downwardly from the bottom of the section 162. A panel 166 is connected to the bottom 168 of section 164. Panel 166 has a curved bottom edge 170.

The virtual block of the present invention gives support to the face of the ceiling without requiring any amount of cement, mortar, bolts or nails. The present invention completely eliminates trowel hand thrown cement, plastering, fine paste and painting. The present invention is a practical technique, simple, versatile and has a very low cost for the finishing work in prefabricated slabs. The virtual block 10 can be formed of a fire-retardant material so as to contribute to the safety of the environment.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A virtual block for attachment to a prefabricated ceiling slab comprising:

a body having a length with a first stirrup at one end and a second stirrup at an opposite end, each of said first and second stirrups having a flat bottom surface suitable for resting on a surface of the ceiling slab;

a first channel formed on one side of said body and extending lengthwise thereacross below said flat bottom surface of the stirrups;

a second channel formed on an opposite side of said body and extending lengthwise thereacross below said flat bottom surface of the stirrups; and a plurality of teeth formed along a bottom edge of said body, said plurality of teeth defining a receptacle area between adjacent pairs of said plurality of teeth.

2. The virtual block of claim 1, said body having a generally trapezoidal shape, said first and second stirrups extending outwardly of said trapezoidal shape.

3. The virtual block of claim 2, said generally trapezoidal shape having a plurality of triangular cut-outs formed in said body.

4. The virtual block of claim 1, said first stirrup comprising:

an arm extending upwardly and outwardly from said one end of said body; and a support portion extending horizontally outwardly of an end of said arm opposite said body, said flat bottom surface formed on said support portion.

5. The virtual block claim 4, said second stirrup comprising:

an arm extending upwardly and outwardly from said opposite end of said body; and a support portion extending horizontally outwardly from an end of said arm opposite said body, said flat bottom surface of said second stirrup formed on said support portion.

6. The virtual block of claim 1, said first and second channels being aligned with each other on opposite sides of said body.

7. The virtual block of claim 1, each of said plurality of teeth having a generally trapezoidal shape, said receptacle being of a trapezoidal shape, said receptacle having an opening at a bottom edge of said body.

8. The virtual block of claim 1, further comprising:

a ceiling panel having a plurality of ribs extending thereacross, said plurality of ribs being respectively received by the receptacle areas between adjacent pairs of said plurality of teeth.

9. The virtual block of claim 8, said ceiling panel having a flat bottom opposite said body.

10. The virtual block of claim 8, said ceiling panel having a tongue extending along an edge of said ceiling panel transverse to said length of said body, said ceiling panel having a groove extending along an opposite edge of said ceiling panel, said groove extending transverse to said length of said body.

11. The virtual block of claim 1, said body having a triangular cross section below said first and second channels, said triangular cross section having a narrow end opposite said channels.

12. The virtual block of claim 1, further comprising:

a profile member having edges in slidable engagement with said channels of said body, said profile member extending over said plurality of teeth.

13. The virtual block of claim 12, said profile member having a plurality of spaced teeth extending along a bottom edge thereof, said plurality of spaced teeth of said profile member defining a receptacle area between adjacent pairs of said plurality of spaced teeth.

14. The virtual block of claim 1, further comprising:

a profile member having a section in slidable engagement with said receptacle area, said profile member extending transverse to said length of said body.

15. The virtual block of claim 14, said profile member having a plurality of spaced teeth formed along a bottom edge thereof, said plurality of spaced teeth defining a receptacle area between adjacent pairs of said plurality of spaced teeth.

16. The virtual block of claim 12, said profile member having a panel extending downwardly from a bottom of said profile member.

17. The virtual block of claim 16, said panel having a smooth edge opposite said body.

18. The virtual block of claim 14, said profile member having a panel extending downwardly from a bottom of said profile member.

19. The virtual block of claim 18, said panel having a curved bottom edge.

20. The virtual block of claim 1, further comprising:

a first ceiling slab having a rib section extending outwardly therefrom; and a second ceiling slab extending in parallel relation to said first ceiling slab, said second ceiling slab having a rib section extending outwardly therefrom, said flat bottom surface of said first stirrup abutting said rib section of said first ceiling slab, said flat bottom surface of said second stirrup abutting said rib section of said second ceiling slab.

* * * * *